United States Patent [19]

Baba

[11] 4,205,738

[45] Jun. 3, 1980

[54] CONTROL MECHANISM FOR MARINE ENGINE

[75] Inventor: Masanao Baba, Takarazuka, Japan

[73] Assignee: Nippon Cable System Inc., Takarazuka

[21] Appl. No.: 865,919

[22] Filed: Dec. 30, 1977

[30] Foreign Application Priority Data

May 21, 1977 [JP] Japan ..... 52-59208

[51] Int. Cl.[2] ..... G05G 9/08; B60K 41/02

[52] U.S. Cl. ..... 192/0.096; 192/0.084; 192/0.07; 74/876; 74/480 B

[58] Field of Search ..... 192/0.096, 0.084, 0.07, 192/0.098; 74/875, 876, 877, 878, 480 B, 471 R

[56] References Cited

U.S. PATENT DOCUMENTS

| | | | |
|---|---|---|---|
| 1,452,900 | 4/1923 | Turner | 74/527 |
| 2,588,650 | 3/1952 | Morse | 192/0.098 |
| 2,759,578 | 8/1956 | Manzolillo | 192/0.098 |
| 2,924,987 | 2/1960 | Pierce | 74/876 |
| 3,741,045 | 6/1973 | Kobayashi | 192/0.096 |
| 4,034,835 | 7/1977 | Baba | 192/0.098 |
| 4,106,604 | 8/1978 | Baba | 74/876 |

*Primary Examiner*—Nile C. Byers, Jr.
*Assistant Examiner*—David C. Reichard
*Attorney, Agent, or Firm*—Armstrong, Kubovcik, Marmelstein & Kubovcik

[57] ABSTRACT

A single lever clutch and throttle control which in normal operation assures that the throttle is held out of operation until the clutch is completely engaged and further assures that the clutch is held in the engaged position during operation of the throttle. An engine warm up mode allows operation of the throttle while the clutch is held disengaged.

13 Claims, 11 Drawing Figures

CONTROL MECHANISM FOR MARINE ENGINE

BACKGROUND OF THE INVENTION

The present invention relates to a novel and improved control mechanism and more particularly to a control mechanism for marine engine which can control both the clutch and throttle by a single lever.

Control mechanisms of the type employing a single lever must fully comply with the following essential requirements:

(1) It is to be possible to shift the clutch of an engine with the rotation of the lever and the throttle is to be operable only after the completion of the clutch shift.

(2) The throttle is to be held out of operation until the engine clutch is completely shifted and the clutch is to be held out of operation during the operation of the throttle.

(3) In warming up the engine, the throttle alone is to be operable, remaining the clutch disengaged with the lever at the neutral position and locked thereat.

Control mechanisms of the type need to fulfill the following additional requirements:

(4) Easy operation even by the unskilled persons who enjoy a motorboat for the purpose of leisure time amusement.

(5) Long durability without troubles regardless of a rough handling by unskilled persons.

(6) Compactness in size and smaller number of components.

Although many kinds of control mechanisms are known in the field hitherto, they have at least one of the following drawbacks and none of the control mechanisms can fully fulfill above requirements.

a. Since the throttle is advanced excessively even before the completion of the clutch shift, it is difficult to drive the boat slowly and constantly.

b. The clutch and/or the throttle are not locked perfectly, or an additional procedure is required to lock them.

d. The operation to warm up the engine is inconvenient, since an additional lever must be activated therefor.

e. Poor durability.

f. It is too large in size to apply it to a boat of small size.

OBJECTS OF THE INVENTION

An object of the invention is to provide an improved control mechanism for marine engine.

Another object of the invention is to provide a control mechanism for marine engine by which the throttle can be held out of operation until the engine clutch is completely engaged, and the clutch can be held in its fully engaged position during the operation of the throttle.

A further object of the invention is to provide a control mechanism which is very simple in construction, operable without any troubles and economical in manufacturing.

Another object of the invention is to provide a control mechanism for marine engine in which the clutch and throttle are operable by a single lever with safety and security.

Another object of the invention is to provide a control mechanism for marine engine which is compact in size and has an enough durability.

Another object of the invention is to provide a control mechanism for marine engine in which the clutch operating member is turnable about 90 degree in both directions from a neutral position and the throttle operating member is turnable about 180 degree in both directions from the neutral position.

Another object of the invention is to provide a control mechanism where the angular range of rotation of the throttle drive member is adjustable independently of that of the clutch operating member.

Still another object of the invention is to provide a control mechanism for marine engine provided with an engine warming-up means which is operable with ease, safety and security.

Other objects of the invention will become apparent from the following description with reference to the accompanying drawings.

DETAILED DESCRIPTION OF THE INVENTION

Figure 1:
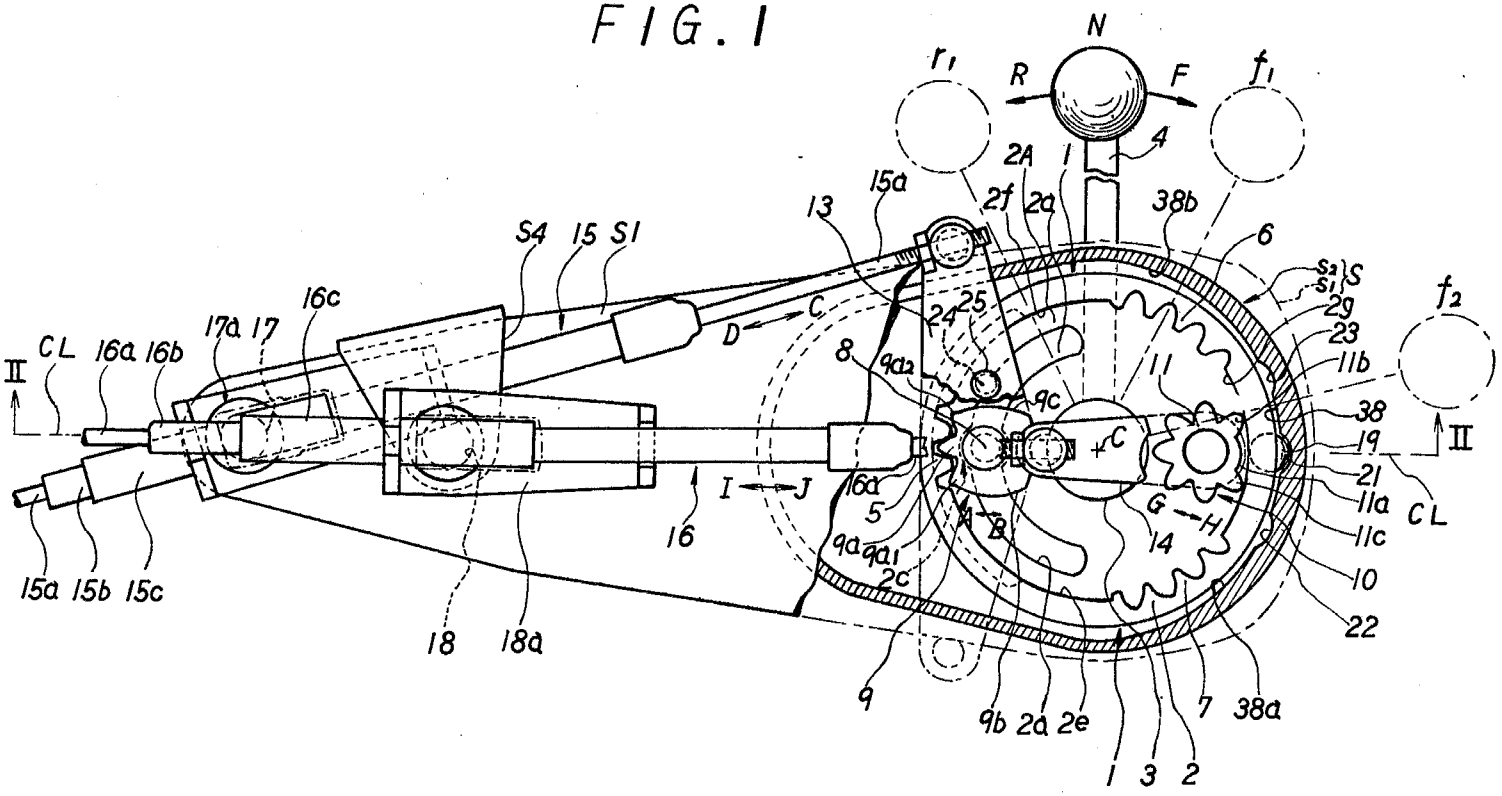
FIG. 1 is a front view showing an embodiment of the control mechanism of the invention with a base plate partially removed.
Figure 2:
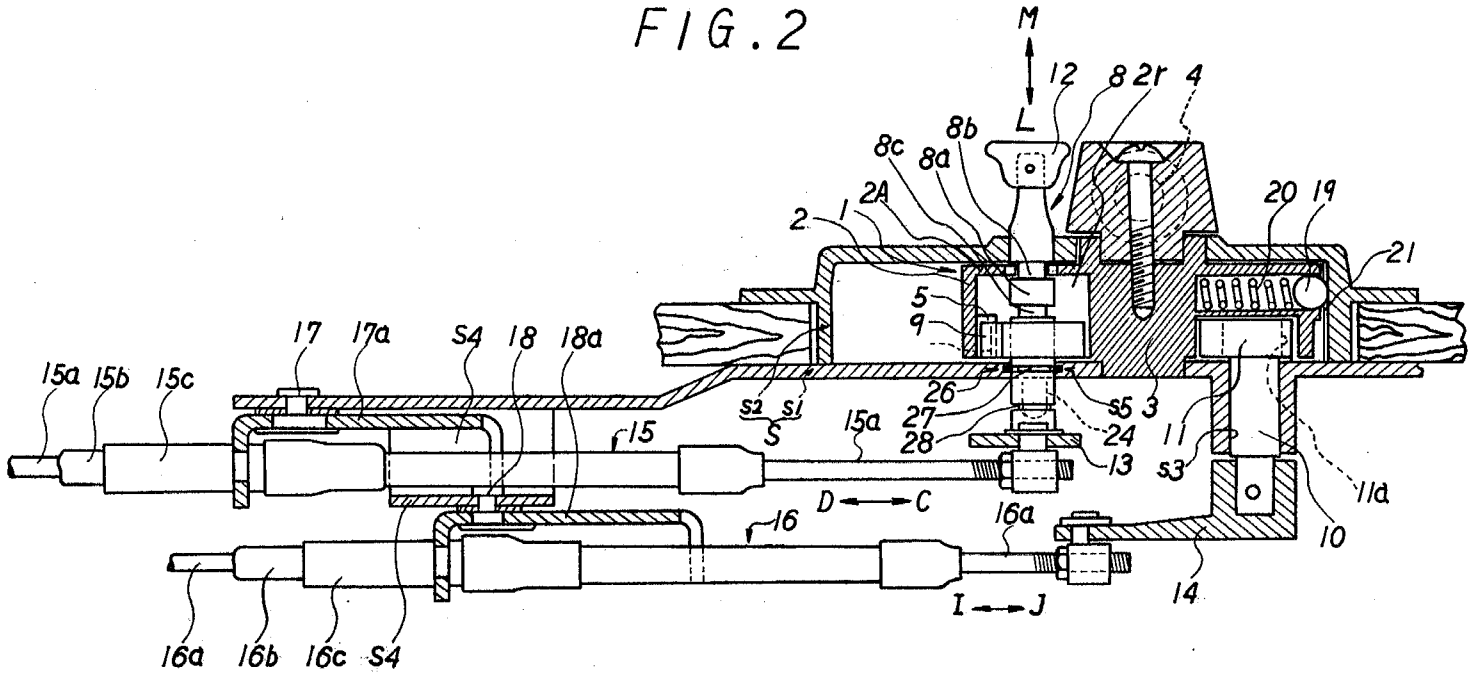
FIG. 2 is a view in section approximately taken along the line II—II in FIG. 1.

With reference to FIGS. 1 and 2, a frame member S comprises a base plate S1 and a casing S2 secured to the base plate S1 by a suitable means (not shown). A main lever 4 is fixedly mounted on a drive member 1 rotatably supported by the frame member S. The drive member 1 comprises a center shaft 3 and a cylindrical portion 2 having a circular end wall 2A at one side thereof.

Inside of the cylindrical portion 2 of the drive member 1 is formed with three internal gear portions 5, 6, 7 (namely a first gear portion 5 and second gear portions 6, 7) and three circular arc locking surfaces *2e, 2f, 2g* disposed between the respective gear portions, which are concentric with the center C of the drive member 1. The teeth of the internal gear portions 5, 6, 7 are suitably higher than the locking surfaces *2e, 2f, 2g*. The end wall 2A is formed with a circular arc aperture *2a* centered about the center C of the drive gear. The circular arc aperture *2a* has in the middle thereof a cutout portion *2c* having a diameter larger than the width of the aperture *2a*. The first internal gear portion 5 is engageable with a clutch pinion 9 formed on a clutch shaft 8 which extends through the cutout portion 2c and is rotatably and axially displaceably supported on the frame member S. The second internal gear portions 6, 7 are engageable with a throttle pinion 11 formed on a throttle shaft 10 which is rotatably received in a bearing bore S3 pierced through a boss formed on the base plate S1. The clutch shaft 8 has a thick portion 8a and two groove-like portions 8b, 8c having diameters smaller than that of the thick portion 8a. The thick portion 8a is insertable only into the cutout portion 2c and the grooves 8b, 8c are slidable along the circular arc aperture 2a.

The clutch pinion 9 has several teeth 9a and two locking portions 9b, 9c extending therefrom. As seen in FIG. 2, one end of the clutch shaft 8 is fitted with a knob 12 and the other end thereof is mounted fixedly a clutch operating member 13 formed with an engaging means, namely locking hole 25 through which the clutch locking means, e.g. a pin 24 extending from the base plate S1 in this embodiment is insertable. Extending from a suitable portion of the clutch operating member 13 is a pin, to which is pivoted an end connector fixed to the inner member 15a (steel rod is preferably available for the end portion thereof) of a clutch control cable 15 for operating a clutch of an engine (not shown). The outer tube 15b of the clutch control cable 15 is rockably supported through a tubular supporter 15c by means of an attachment 17a pivoted on the base plate S1 by a pin 17.

The drive member 1 is formed with a surplus space 2r having the width which is larger than the width of the clutch pinion 9. The clutch shaft 8 is axially displaceable into the surplus space 2r until the clutch pinion 9 comes into contact with the inner surface of the end wall 2A and with the inner surface of the base plate S1 respectively. The clutch shaft 8 is provided with two additional grooves 27, 28 which engages with the elastic ring 26 fitted in the groove S5 of the base plate S1, whereby the ring 26 restrains the clutch shaft 8 which is axially displaceable from escapement.

At upper end of the throttle shaft 10 is formed with the throttle pinion 11 provided with a locking means comprising two teeth 11b, 11c and an untoothed portion 11a disposed therebetween. On the other end of the throttle shaft 10 is fitted with a throttle operating member 14 connected with an inner member 16a (the steel rod is also available for the end portion thereof) of the throttle control cable 16. A tubular supporter 16c holding therein an outer tube 16b of the throttle control cable 16 is rockably supported by means of an attachment 18a pivoted on a L-shaped portion S4 of the base plate S1 by a pin 18.

The embodiment of the invention has a restraining means comprising a ball detent 19 which is fitted in a cavity formed in the drive member 1 and biased outwardly by a spring 20 and recesses 21, 22, 23 formed on the inner surface of the casing S2, with which the ball detent 19 is engageable. This restraining means of the invention will be described in greater detail hereinafter.

Figure 4:
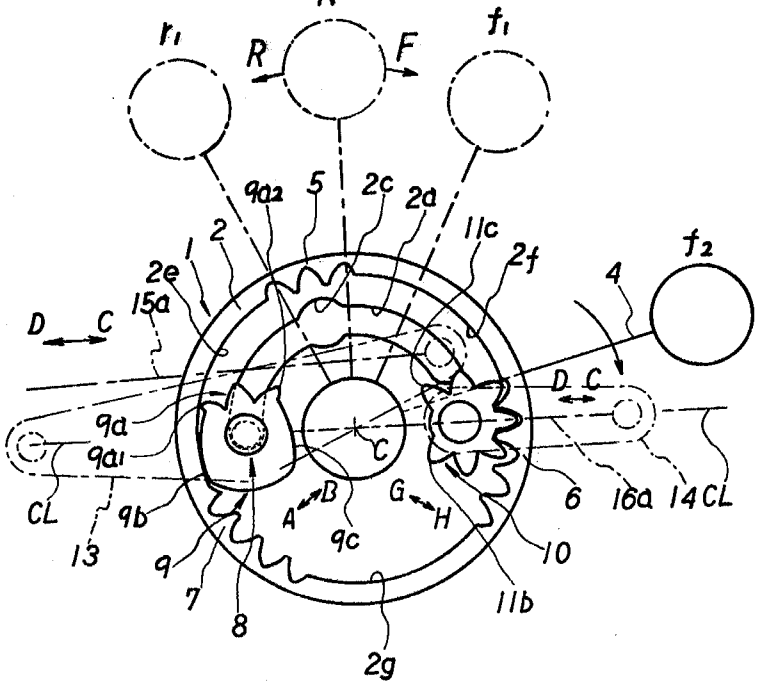
FIG. 4 is a view similar to FIG. 3, but showing the lever turned to f2 position.
Figure 3:
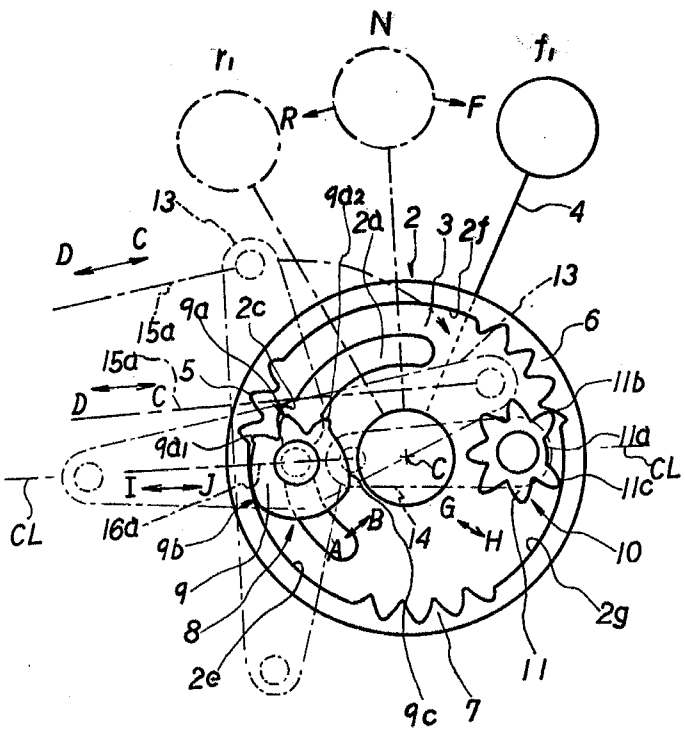
FIG. 3 is a partial front view showing the embodiment with a lever 4 turned to f1 position.
Figure 5:
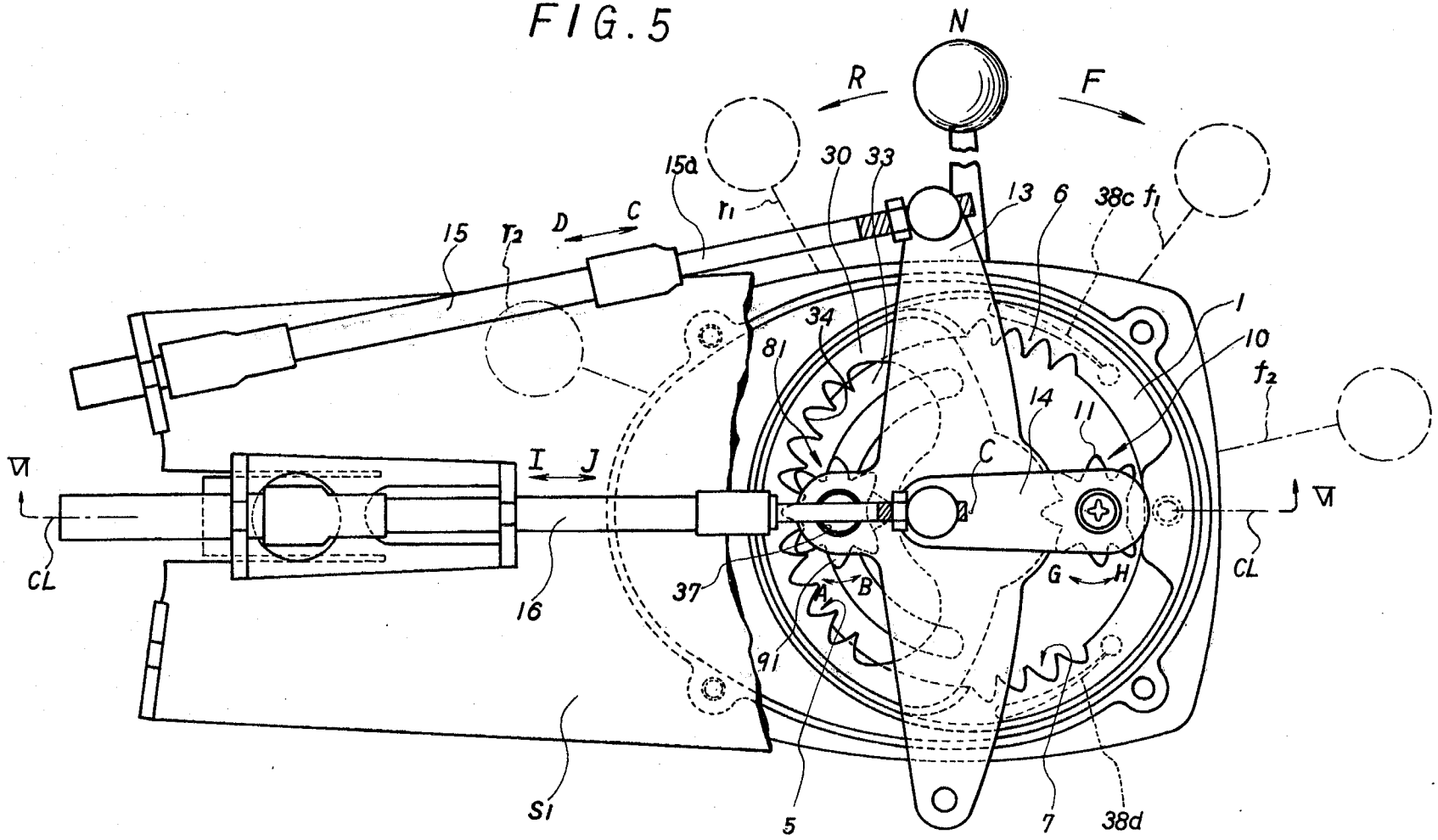
FIG. 5 is a front view showing another embodiment of the control mechanism of the invention with a base plate partially removed.

The operation of the embodiment will now be disclosed with reference to FIGS. 3, 4.

When the drive member 1 is turned in a direction F from neutral position N by the lever 4, the clutch pinion 9 rotates in a direction A in meshing engagement with the first internal gear portion 5 of the drive member 1, turning the clutch operating member 13 in the direction A, whereby the inner member 15a of the clutch control cable 15 is pulled toward a direction C and the clutch of the engine is shifted for example into a forward position.

Further rotation of the clutch operating member 13 in the direction A turns moreover the clutch shaft 8 toward the direction A. As a result, an end tooth 9a1 and the locking portion 9b of the clutch shaft 8 are in opposing relation to the locking surface 2e of the cylindrical portion 2 of the drive member 1 whereupon the clutch shaft 8 stops and is locked against turning, as seen in FIG. 3. In a preferred embodiment of the invention, the clutch operating member 13 which is positioned on the line approximately at right angle to the center line CL turns about 90 degree when the lever rotates to a position f1, whereby the clutch control cable 15 comes to on the center line CL and to thereby minimize the torsional load acting on the clutch shaft 8 caused by a force of the engine clutch and applied by way of the clutch control cable 15.

On the other hand, when the lever 4 is in the neutral position N as well as the clutch shaft 8 is in rotation as described above, the throttle shaft 10 is locked against turning, since the two teeth 11b, 11c on the opposite sides of and adjacent to the untoothed portion 11a are opposing relation to the locking surface 2g as shown in FIG. 1.

On or before the clutch pinion 9 stops, the tooth 11b of the throttle pinion 11 preferably begins to engage with the second internal gear portion 6 of the drive member 1, as shown in FIG. 3.

Further rotation of the lever 4 over the position f1 in the direction F as seen in FIG. 4, turns the throttle pinion 11 and the throttle operating member 14 in the direction G in meshing engagement with the second internal gear portion 6. During this rotation of the throttle operating member 14, the clutch operating member 13 is kept halt by virtue of the sliding contact of the locking portion 9b along the locking surface 2e of the drive member 1, whereby alone the inner member 16a of the throttle control cable 16 is pulled in the direction C and to thereby drive the boat gradually. When the lever turns to the location f2, the throttle is preferably advanced at maximum extent and the boat is driven in maximum speed.

In a preferred embodiment of the invention, since the throttle operating member 14 which is on the center line CL at first state rotates about 180 degree and it comes to on the center line CL again after the rotation thereof, the torsional load acting on the throttle shaft 10 through the throttle cable 16 can be minimized.

When the lever 4 in the above-mentioned position is returned into a direction R, the drive member 1 rotates in the direction R therewith, turning the throttle shaft 10 and throttle operating member 14 in a direction H in meshing engagement with the second internal gear portion 6, whereby the inner member 16a of the throttle control cable 16 is pushed in the direction D and to thereby slow down the boat. When the lever reaches the position f1, the tooth 11b of the throttle pinion 11 comes to contact with locking surface 2f, whereupon the throttle shaft 10 is locked against turning and the throttle operating member 16 returns to its original position, minimizing the advance of the throttle.

On the other hand, the teeth 9a of the clutch shaft 8 which was locked against turning by the locking surface 2e during the rotation of the throttle shaft 10 begin to engage with the first internal gear portion 5 after the completion of the locking action of the throttle shaft 10. When the lever is turned to the position N, the clutch operating member 13 equipped on the clutch shaft 8 is reversed to its original position and the clutch is shifted to neutral position, whereby the boat is stopped soon.

When the lever 4 is turned toward a direction R from the neutral position N to position r1, the clutch shaft 8 and the clutch operating member 13 are turned toward a direction B, with the result that the inner member 15*a* of the clutch cable 15 is pushed in a direction D to shift the clutch for example to reverse position and the clutch shaft 8 is locked against turning. At the same time, the throttle which has been locked comes to be rotatable. With the turning of the lever from position r1 further toward the direction R, the throttle operating member 14 fixed on the throttle shaft 10 is turned in direction H, with a result that the inner member of the throttle cable is pulled in the direction J, whereby the boat is propelled backward.

The control mechanism of the invention operates in the following manner when warming up the engine. When the clutch shaft 8 is pulled in a direction M by the knob 12, the clutch pinion 9 is disengaged with the first internal gear portion 5 and is inserted into the surplus space 2*r* of the drive member 1, whereby the locking means namely a pin-like portion 24 extending from the base plate S1 engages in the locking hole 25 (shown in FIG. 1) formed on the clutch operating member 13 and to thereby lock the clutch operating member 13 at the neutral position. With the pulling operation of the clutch shaft 8 in the direction M, the elastic ring 26 surrounding the shaft 8 shifts from the groove 27 to groove 28 and the shaft 8 is retained in the position.

Consequently, with the rotation of the lever 4 in the direction F or R, the inner wire 16*a* of the throttle cable 16 is operable independently of the clutch operating member 13, whereby the warming up operation of the engine is suitably performable.

In the warming up operation, since the groove 8*c* of the clutch shaft 8 is slidable along the circular arc aperture 2*a*, the drive member 1 is not prevented from rotation and the clutch shaft 8 is held against escapement into a direction L. Morefurther, since the thick portion 8*a* of the clutch shaft 8 can pass only through the cutout portion 2*c* which is formed correspondingly to the neutral position of the lever 4, the clutch shaft 8 is kept in the neutral position during the advancement of the throttle, whereby the boat is quite safe to operate without causing any sudden start of boat.

The clutch control cable 15 and the throttle control cable 16 which are subjected to a circular arc motions with the rotations of the clutch operating member 13 and the throttle operating member 14, are effectively prevented from being broken down owing to the attachments 17*a*, 18*a* which are rockably mounted on the frame member S.

As will be apparent from the foregoing descriptions, the present embodiment has following functions required of control mechanism.

(1) Since the throttle is held out of operation until the clutch is completely shifted, the boat can be controlled finely permitting it possible to keep the boat at the constant position against a tide and to make the operation for going in and out of the port easy and safe.

(2) Since the throttle shaft 10 is perfectly held against turning during the rotation of the clutch shaft 8 and on the contrary the clutch shaft is stopped during the operation of the throttle shaft 10, the operation of the boat is quite safe free from such troubles as inadvertent starts or injuries of the clutch of an engine.

(3) It is easily possible to warm up the engine only by pushing the clutch shaft 8 axially, and additionaly it is safe to warm up the engine since the clutch shaft 8 is locked against axial movement during the operation of the throttle shaft 10.

(4) The control mechanism of the invention is easily operable even by unskilled persons, since both the clutch and throttle are controlled by a single lever.

(5) The control mechanism of the invention is very simple in construction and operable without any troubles.

(6) Since involute teeth are available for the clutch pinion 9, throttle pinion 11 and the internal gear portions 5, 6, 7, the wear in the respective teeth is extremely small and the control mechanism of the invention is operable smoothly and lightly.

(7) Since the clutch operating member 13 is turnable about 90 degree and the throttle operating member 14 is turnable about 180 degree, it is possible to arrange both throttle cable and the clutch cable so that they come to on the centerline CL after full turning thereof, minimizing the load and wear subjected between the locking surfaces 2*e*, 2*f*, 2*g* and the teeth 11*b*, 11*c* or the locking portions 9*b*, 9*c* regardless of an external force acting in either direction and delivered from the return-spring or the like through the clutch control cable 15 or the throttle control cable 16, whereby the control mechanism of the invention can be controlled accurately even after the operation for a long period of time without producing play in the throttle cable and the control cable.

(8) Since the clutch shaft 8 and the throttle shaft 10 turnable about 90 or 180 degree in either directions respectively, the control mechanism of the invention is compact in size.

(9) Since the rotatable angular regions of the clutch shaft and the throttle shaft are alterable independently, specifications of the control mechanism of the invention can be adjustable easily according to the kind of the engine. As obvious by those skilled in the art, the control mechanism of the invention can completely fulfill the requirements required in the control mechanism for marine engine.

Another embodiment of the invention (hereinafter referred to as a second embodiment) will be described below.

For simplification of this description, reference will be made mainly to the parts which differs from those in the aforementioned embodiment of FIGS. 1 to 4 (hereinafter referred to as a first embodiment), and parts and portions which are the same as those in the first embodiment are designated same numbers. With reference to the second embodiment in FIGS. 5 to 8, the clutch operating member 13 which is formed with a locking hole 37 and equipped with an inner member 15*a* of the clutch cable 15 is fixedly mounted on a second clutch member 30 which is turnable by the clutch shaft 81 about the center C and rotatably supported on the base plate S1. The clutch pinion 91 of the clutch shaft 81 comprises a first gear portion 92 which is engageable with the first internal gear portion 5 of the drive member 1 and a second gear portion 93 which is engageable with the internal gear 34 of the second clutch member 30. The second clutch member 30 is formed with a circular arc apertured portion 33 having an internal gear 34 at the inner surface thereof, which is centered about the center C, and the clutch shaft 81 extends through the apertured portion 33.

Figure 6:
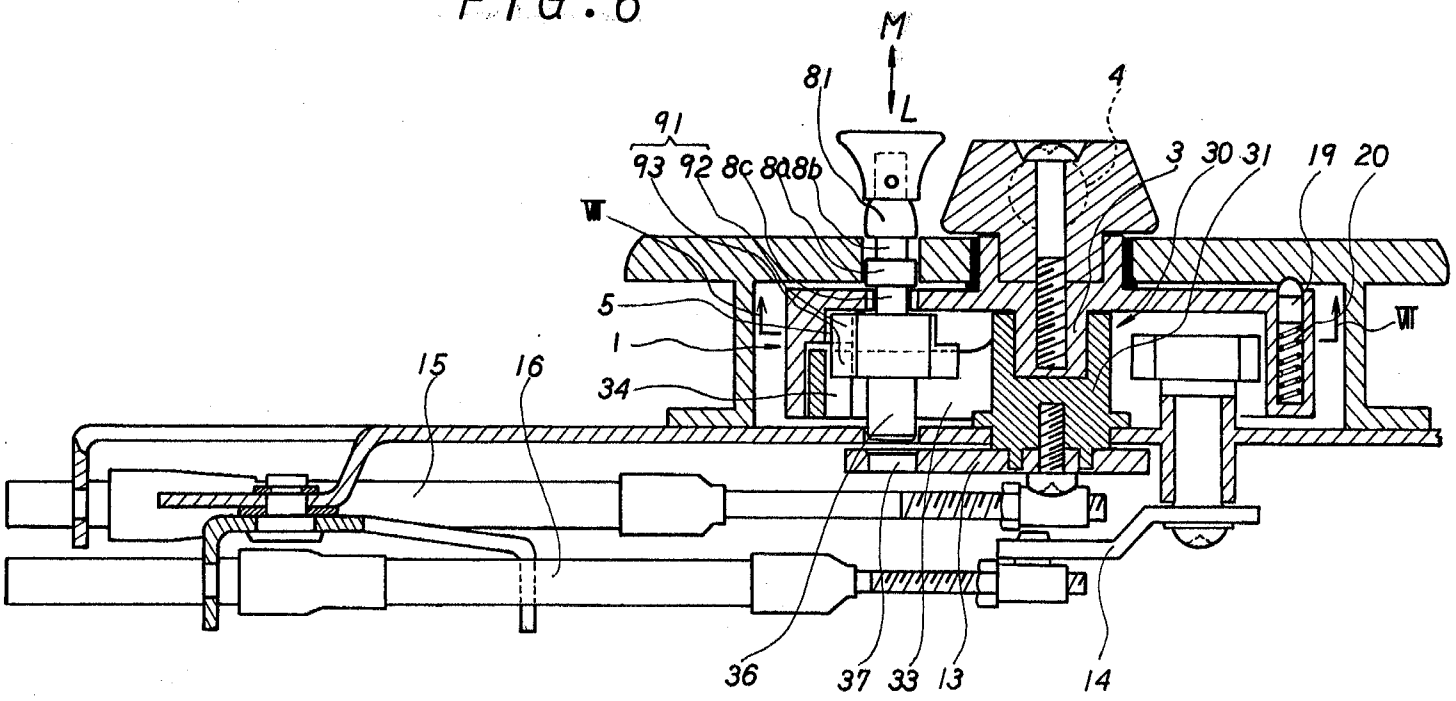
FIG. 6 is a view in section approximately taken along the line VI—VI in FIG. 5.
Figure 7:
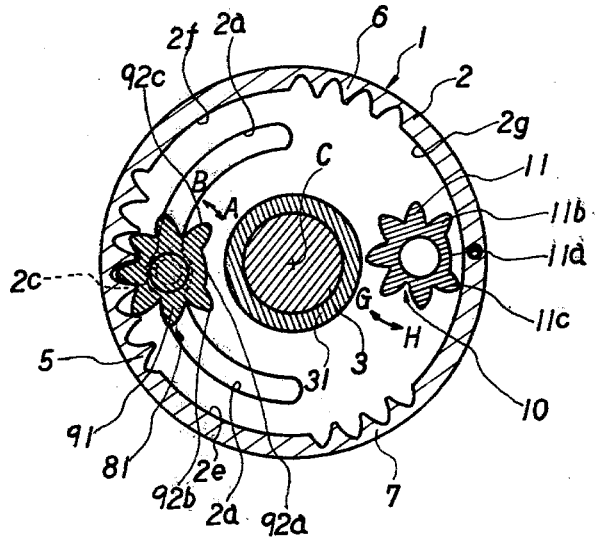
FIG. 7 is an elevational view in section taken along the line VII—VII in FIG. 6.
Figure 8:
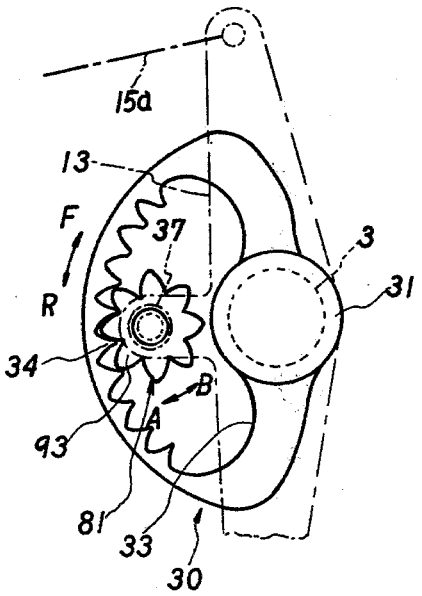
FIG. 8 is a front view showing a clutch pinion and a second clutch member, as well as a clutch operating member in chain line.

As seen in FIG. 6, the clutch shaft 81 is displaceable axially and inwardly, on the contrary to that of the first embodiment.

The operation of the second embodiment of the invention will be described.

The main lever 4 equipped on the drive member 1, when turned in direction F from neutral position N to the position f1, rotates the clutch shaft 81 in direction A in meshing engagement with the first gear portion 92. With the rotation of clutch shaft 81, the second clutch member 30 equipped with the clutch operating member 13 turns in a direction F by virtue of gearing with the second gear portion 93 of the clutch pinion 91, pulling the wire of the clutch cable in a direction C, and to thereby shift the clutch for example to forward position. When the lever 4 turns further, two teeth 92*b*, 92*c* on opposite sides of and adjacent to the untoothed portion 92*a* of the first gear portion 92 are in sliding contact with the inner surface 2*e*, whereby the clutch shaft 81 and the clutch operating member 13 are locked against turning.

Similarly, when the lever 4 is turned in the direction R from the position N, the clutch cable 15 is pushed in a direction D and to thereby shift the clutch for example to reverse position.

When the lever is turned beyond the position f1 or r1 to position f2 or r2, the throttle shaft 10 rotates in similar manner to that of the first embodiment in meshing engagement with the second internal gear portion 6 or 7, turning the throttle operating member equipped with the inner wire 16*a* of the throttle control cable 16 and to thereby control the engine.

Also in the second embodiment, the throttle is held out of operation during the rotation of the clutch shaft 81 owing to the locking means comprising the untoothed portion 11*a* and two teeth 11*b*, 11*c*, and the clutch shaft 81 is held in its shifted position during the operation of the throttle.

To warm up the engine, when the clutch shaft 81 is drawn in a direction L in FIG. 6, the first gear portion 92 of the clutch shaft is disengaged with the first internal gear portion 5 of the drive member 1 and the end portion 36 of the clutch shaft is inserted into the locking hole 37, whereby the clutch operating member 13 is held against turning at the neutral position and therefore the throttle operating member is alone turnable independently of the clutch operating member, with the turning of the lever.

As obvious from the preceding description, the second embodiment of the control mechanism of the invention not only attains the full functions above described with respect to the first embodiment, but also the rotational ratio between the lever 4 and the clutch operating member 13 can be arranged effectively smaller than that of the first embodiment, whereby the operation for the clutch shift becomes lighter and smoother proportionally. Morefurther, since the rotational center of the clutch operating member 13, and, consequently, the position of the pin 17 (shown in FIG. 2) can be brought nearer to the center of the throttle shaft 10, the length of the base plate S1 can be shortened and therefore the control mechanism of the invention can be made smaller.

Figure 9:
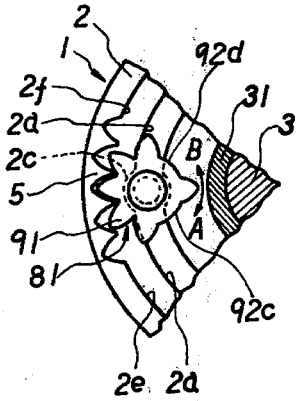
FIG. 9 is a partial front view showing another example of the clutch pinion.
Figure 10:
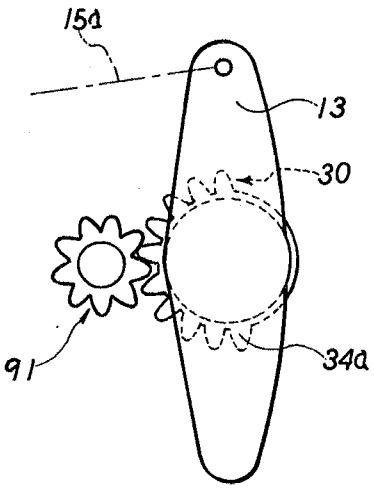
FIG. 10 is a front view showing another example of the second clutch member.

In the second embodiment shown in FIGS. 5 to 8, the first gear portion 92 of the clutch shaft 81 can be formed with two locking means 92*c*, 92*d* as shown in FIG. 9 if necessary, although the angle of rotation of the clutch operating member 13 becomes relatively small. Further, instead of employing the second clutch member 30 having an internal gear portion 34, a second clutch member having an outer gear portion 34*a* formed on the shaft-side as shown in FIG. 10 can be available.

In the embodiment of the invention shown in FIGS. 1, 2, the ball detent 19 frictionally engageable with the recesses 21, 22, 23 which are positioned corresponding to the lever positions N, f1, r1 respectively indicates to the operator by feel that the clutch is neutralized or shifted to forward or reverse position.

Engaging surfaces 38*a*, 38*b* extending from the recesses 22, 23 outwardly on which the ball detent 19 runs after disengagement with the recess 22, 23 are formed so that they become distant gradually and progressively from the center C of the drive member 1. Therefore, the lever 4 is prevented from displacement toward the position N when the ball detent 19 is on the engaging surfaces 38*a*, 38*b*, against an external froce due to return-spring of an engine acting in the direction I by way of the inner member 16*a*, whereby the advancement of the throttle is kept in the position even when the hand is released from the lever and to thereby faciliate the control of boat.

In place of the arrangement of the restraining mechanism shown in FIGS. 1, 2 and 5, 6, the ball detent 19 can be provided in the frame member S and, therefore, the engaging surfaces can be formed around the drive member (not shown). That is, the drive member and the frame member have the restraining member or the engaging surface, provided that, where one of the drive member has the restraining member, the other one has the engaging member.

The engaging surfaces may be formed in the inner side of the frame member S and the ball detent 19 biased by a spring may be disposed in a hole formed in axial direction in the drive member 1 as seen in FIG. 6. In the case, the engaging surface may be preferably formed with grooves 38*c*, 38*d* extending circularly from the recesses 22, 23 and having depth which grows progressively deeper. The restraining mechanism for the lever of the invention is simple in construction and is quite effective to operate.

Figure 11:
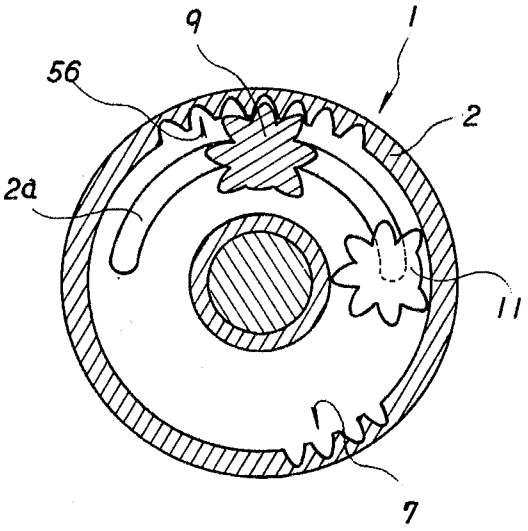
FIG. 11 is a front view showing another example of a drive member.

Additionally, although the drive member is so described that it has three internal gear portions 5, 6, 7 individually separated, the second internal gear portion 6 or 7 can be combined with the first internal gear portion 5 depending upon the location of the clutch shaft 8, 81, where the drive member is seen as if it has two internal gear portions 7, 56 as shown in FIG. 11.

What we claim is:

1. A control mechanism for a marine engine comprising:

a frame member;

a drive member rotatably supported by said frame member and having a cylindrical portion equipped with a side wall, said cylindrical portion being formed with a first internal gear portion, a second internal gear portion and a circular arc inner surface at an inner periphery thereof, said side wall being formed with a circular arc aperture, a cutout, and an axial surplus space centered about the center of said drive member, said drive member being equipped with a lever;

a clutch shaft rotatably and axially displaceably supported in said frame member and extending through said circular arc aperture, said clutch shaft being provided with a clutch pinion receivable within said axial surplus space, said clutch pinion having at least one locking means lockable on said circular inner surface and a thick portion which is insertable only through said cutout portion and two grooves which are slidable along said circular arc aperture, said clutch pinion being engageable with said first internal gear portion of said drive member, and disengageable with said first internal gear portion with axial displacement of said clutch shaft;

a clutch operating member operable by said clutch shaft;

a throttle shaft rotatably supported by said frame member and provided with a throttle pinion having at least one locking means, said throttle pinion being engageable with said second internal gear portion, said locking means being lockable on said circular arc inner surface; and a throttle operating member fixedly mounted on said throttle gear.

2. The control mechanism for marine engine as defined in claim 1, wherein said frame member is equipped with a clutch locking means, and the clutch operating member is provided with an engaging means which is engageable with said clutch locking means of the frame member.

3. The control mechanism for marine engine as defined in claim 2, wherein said clutch locking means comprises a pin extending from the frame member and the engaging means comprises a hole formed in the clutch operating member.

4. The control mechanism for marine engine as defined in claim 1, wherein said clutch operating member is secured to the end of the clutch shaft and is operable by the clutch shaft.

5. The control mechanism for marine engine as defined in claim 1, wherein said clutch operating member is secured to a second clutch member having a gear portion which is engageable with the clutch pinion and operable thereby.

6. The control mechanism for marine engine as defined in claim 5, wherein said second clutch member is supported concentrically with the drive member.

7. The control mechanism for marine engine as defined in claim 5, wherein said clutch pinion of the clutch shaft comprises a first gear portion engageable with the first internal gear portion of the drive member and a second gear portion engageable with the gear portion of the second clutch member.

8. The control mechanism for marine engine as defined in claim 1, wherein said drive member and the frame member have a restraining member biased by an elastic member an engaging surface along which the restraining member runs, provided that, where one of the drive member the frame member has the restraining member, the other one has the engaging member.

9. The control mechanism for marine engine as defined in claim 8, wherein said restraining member is a ball detent.

10. The control mechanism for marine engine as defined in claim 8, wherein said restraining member comprises a pin having a tapered head.

11. The control mechanism for marine engine as defined in claim 8, wherein said engaging surface is formed with a grooved portion in which the head of the restraining member is engageable in wedging contact therewith.

12. The control mechanism for marine engine as defined in claim 11, wherein said grooved portion has a depth progressively increased toward a direction away from the neutral position of the lever member.

13. The control mechanism for marine engine as defined in claim 8, wherein said engaging surface is so formed that it becomes distant gradually and progressively from the center of the drive member.

* * * * *